US009507287B2

(12) United States Patent
Takagami et al.

(10) Patent No.: US 9,507,287 B2
(45) Date of Patent: Nov. 29, 2016

(54) IMAGE FORMING APPARATUS WITH CHARGING MEMBER THAT ELECTROSTATICALLY CHARGES IMAGE CARRIER

(71) Applicant: KYOCERA Document Solutions Inc., Osaka (JP)

(72) Inventors: Ai Takagami, Osaka (JP); Hisashi Mukataka, Osaka (JP); Masaki Kadota, Osaka (JP); Takahiko Murata, Osaka (JP); Maki Ike, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/015,826

(22) Filed: Feb. 4, 2016

(65) Prior Publication Data

US 2016/0238961 A1 Aug. 18, 2016

(30) Foreign Application Priority Data

Feb. 13, 2015 (JP) ..... 2015-026067
Nov. 4, 2015 (JP) ..... 2015-216778

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
USPC ..... 399/50
See application file for complete search history.

(56) References Cited

U.S. PATENT DOCUMENTS 6,122,460 A * 9/2000 Meece ..... G03G 15/0266 399/176
6,645,688 B2 * 11/2003 Hashizume ..... G03G 5/08285 399/159
7,643,765 B2 * 1/2010 Miyaji ..... G03G 15/0266 399/176
2002/0001482 A1 1/2002 Iinuma ..... 399/159
2002/0115012 A1 * 8/2002 Hashizume ..... G03G 5/08214 430/125.3
2004/0136740 A1 * 7/2004 Shoji ..... G03G 21/1889 399/50
2005/0271406 A1 * 12/2005 Okano ..... G03G 21/1889 399/50
2014/0079419 A1 * 3/2014 Itani ..... G03G 15/0266 399/50

FOREIGN PATENT DOCUMENTS

JP 06180520 A * 6/1994
JP 2001-337470 A 12/2001
JP 2009-192568 A 8/2009

* cited by examiner

*Primary Examiner* — Billy Lactaoen
*Assistant Examiner* — Arlene Heredia Ocasio
(74) *Attorney, Agent, or Firm* — Stein IP, LLC

(57) ABSTRACT

An image forming device includes an image carrier on the surface of which a toner image is formed, a cleaning member arranged in contact with, for cleaning, the surface of the image carrier, a charging member for electrostatically charging the image carrier, a bias applying device, and a control portion. The bias applying device applies a charging bias having DC and AC biases superimposed on each other to the charging member. The control portion controls the charging bias applied to the charging member by the bias applying device. As the AC bias applied to the charging member, the control portion uses, in a first period from the start of use of the image carrier to a predetermined time thereafter, a first AC bias and, in a second period subsequent to the first period, a second AC bias higher than the first AC bias.

4 Claims, 5 Drawing Sheets

IMAGE FORMING APPARATUS WITH CHARGING MEMBER THAT ELECTROSTATICALLY CHARGES IMAGE CARRIER

INCORPORATION BY REFERENCE

This application is based upon and claims the benefit of priority from the corresponding Japanese Patent Application No. 2015-026067 filed on Feb. 13, 2015 and Japanese Patent Application No. 2015-216778 filed on Nov. 4, 2015, the entire contents of both of which are incorporated herein by reference.

BACKGROUND

The present disclosure relates to an image forming apparatus which forms an image on a recording sheet. More particularly, the present disclosure relates to a method for controlling a charging bias for electrostatically charging an image carrier on the surface of which a toner image is formed.

Among image forming apparatuses such as printers, copiers, facsimile machines, multifunction peripherals having the functions of more than one of them, etc., some are known which are provided with a photosensitive drum as an example of an electrophotographic photosensitive member, a charging member such as a charging roller which electrostatically charges the surface of the photosensitive drum, and a cleaning blade which is arranged in contact with the surface of the photosensitive drum and which removes toner or external additive left unused on the surface of the photosensitive drum.

Such a charging member is arranged in contact with or close to the image carrier, and discharge products produced due to electric discharge by the charging member attach to the surface of the image carrier. This increases the friction resistance between the surface of the image carrier and the cleaning blade, and makes the cleaning blade more likely to suffer from chatter, tears, and stick-slip, resulting in degraded cleaning performance of the cleaning blade. As a result, with an increased slipping amount of toner and external additive, the charging member is contaminated, and toner and external additive left uncleaned are fixed to the surface of the image carrier, resulting in image quality degradation and image formation defects.

In particular, when an image carrier having on its surface an amorphous silicon layer formed as a photosensitive layer is used, at an early stage after the start of use, owing to surface irregularities ascribable to crystal particles produced when the amorphous silicon layer is formed, the contact area is small between the surface of the image carrier and the cleaning blade, and thus the friction resistance between them is also small; however, as the image carrier continues being used, the irregularities on the surface of the image carrier wear and smoothen, with the result that the friction resistance increases between the surface of the image carrier and the cleaning blade, making the previously mentioned problems more likely to occur.

As a solution, a configuration is known in which an amorphous silicon layer is formed on an aluminum tube having a large surface roughness so as to give the amorphous silicon layer a large surface roughness in advance with a view to suppressing an increase in the friction resistance and degradation in cleaning performance of the cleaning blade. Moreover, another configuration is known in which the driving electric current for the image carrier is monitored and, when the value of the driving electric current is larger than a predetermined value, the AC voltage applied to the charging device is reduced, with a view to suppressing production of discharge products.

SUMMARY

According to one aspect of the present disclosure, an image forming apparatus includes an image carrier, a cleaning member, a charging member, a bias applying device, and a control portion. The image carrier has a toner image formed on its surface. The cleaning member is arranged in contact with the surface of the image carrier, and cleans the surface of the image carrier. The charging member electrostatically charges the image carrier. The bias applying device applies a charging bias having a DC bias and an AC bias superimposed on each other to the charging member. The control portion controls the charging bias applied to the charging member by the bias applying device. In a first period of time from a start of use of the image carrier to a predetermined time thereafter, the control portion uses as the AC bias applied to the charging member a first AC bias, and in a second period of time subsequent to the first period of time, the control portion uses as the AC bias a second AC bias higher than the first AC bias.

Further features and advantages of the present disclosure will become apparent from the description of embodiments given below.

DETAILED DESCRIPTION

Figure 1:
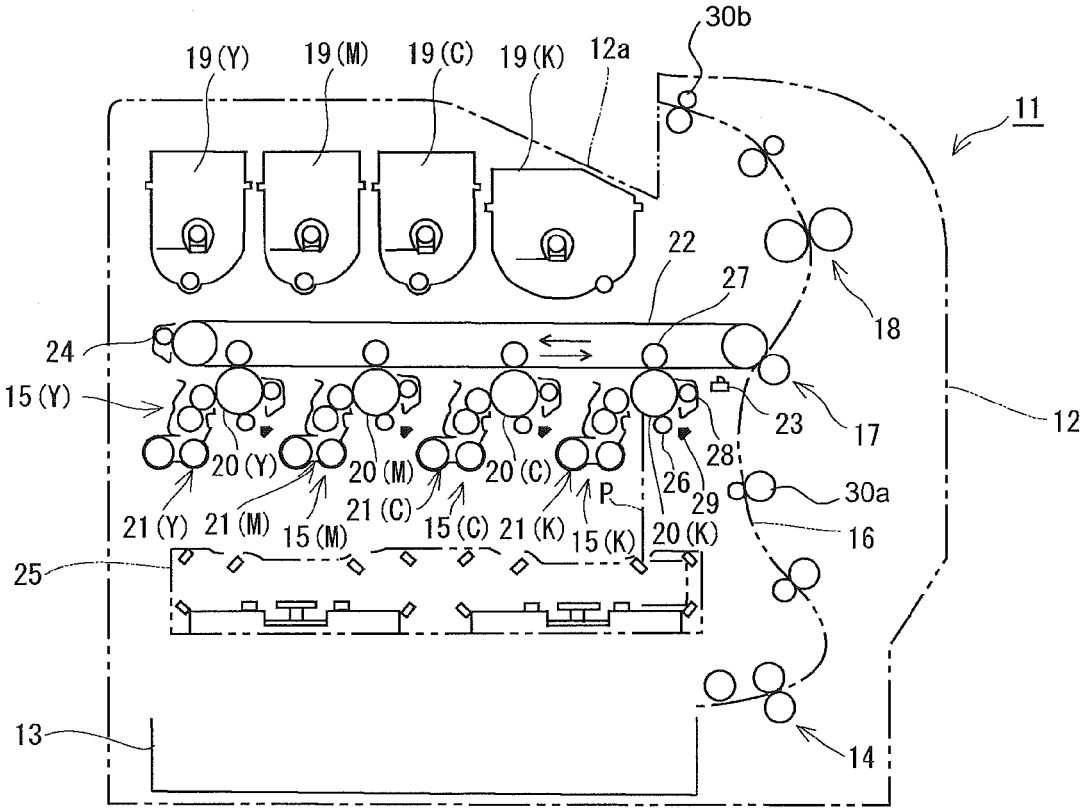
FIG. 1 is a schematic sectional view showing an outline of the construction of a tandem-type color printer as an image forming apparatus 11 according to one embodiment of the present disclosure.
Figure 2:
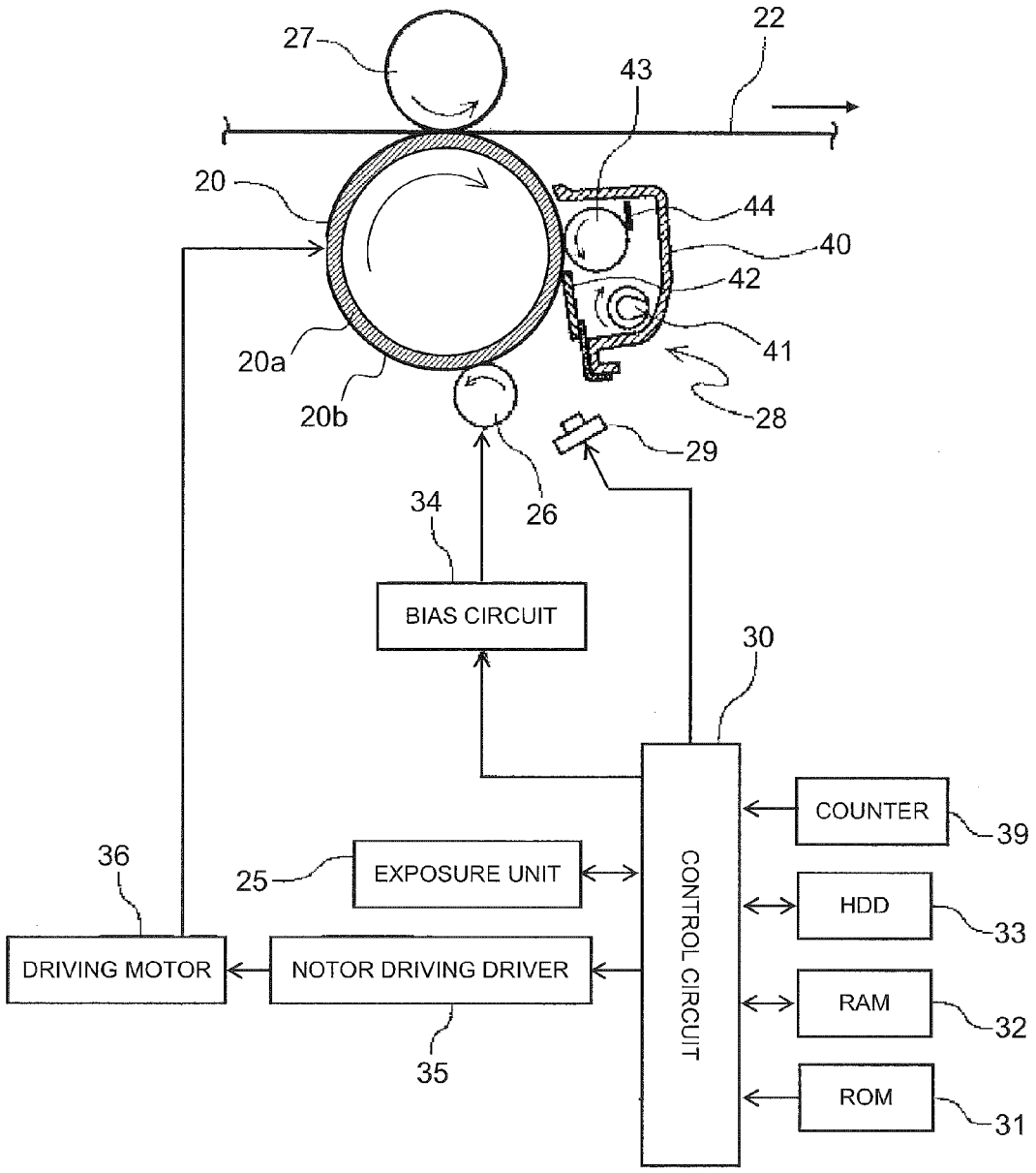
FIG. 2 is a view showing an outline of the structure of a main part, including an image formation processing section 15, of an image forming apparatus 11 according to the present embodiment.

Hereinafter, embodiments of the present disclosure will be described with reference to the accompanying drawings. FIG. 1 is a schematic sectional view showing an outline of the construction of an image forming apparatus 11 according to one embodiment of the present disclosure. FIG. 2 is a view showing an outline of the structure of a main part, including an image formation processing section 15, of the image forming apparatus 11 shown in FIG. 1.

1. Construction of Image Forming Apparatus 11

Overall Construction:

As shown in FIG. 1, the image forming apparatus 11 according to the present embodiment is a tandem-type color printer. The image forming apparatus 11 includes, inside a printer body 12, a sheet feed cassette 13 for storing recording sheets (unillustrated), a sheet feeding portion 14 for feeding one recording sheet after another from the sheet feed cassette 13, an image formation processing section 15 for forming an image on a recoding sheet fed from the sheet feed cassette 13 or from a manual feed tray (unillustrated), a recording sheet transport passage 16 for transporting the recording sheet fed from the sheet feed cassette 13 or from the manual feed tray, a secondary transfer portion 17 for transferring a toner image formed in the image formation processing section 15 to the recording sheet transported along the recording sheet transport passage 16, and a fixing portion 18 for fixing the toner image transferred to the recording sheet in the secondary transfer portion 17.

Structure of Image Formation Processing Section 15:

The image formation processing section 15 adopts, for example, a tandem system in which an image formation process is executed by use of toner (developer) of four colors, namely yellow (Y), magenta (M), cyan (C), and black (K). In the following description, a reference numeral is accompanied by an indication of color in parentheses (Y, M, C, or K) only when the ongoing description applies to a particular color; where the ongoing description applies to all colors, a reference numeral stands alone.

The image formation processing section 15 includes, so as to correspond to different colors (Y, M, C, and K), a plurality of toner containers 19 for storing toner for replenishment, a plurality of photosensitive drums 20 for forming toner images of the different colors based on print data (image data) transmitted from an externally connected device such as a personal computer, a plurality of developing devices 21 for feeding toner to the photosensitive drums 20, an endless intermediate transfer belt 22 for primarily transferring thereto the toner images formed on the photosensitive drums 20, a belt cleaning device 24 for removing unused toner and the like attached on the surface of the intermediate transfer belt 22, the belt cleaning device 24 being located on the upstream side of the most upstream-side intermediate transfer belt 22 with respect to its rotation movement direction, and an exposure unit 25 for irradiating the photosensitive drums 20 with light beams.

Structure of Photosensitive Drum 20:

The photosensitive drum 20 has a photosensitive layer formed on the surface of a support (base body). Here, as shown in FIG. 2, the photosensitive drum 20 is composed of a cylindrical metal tube 20*a* and a photosensitive layer 20*b* formed on the surface of the tube 20*a*. The tube 20*a* is one example corresponding to what is called a support in the present disclosure. Examples of metals for forming the tube 20*a* include aluminum, iron, titanium, magnesium, etc. As the photosensitive layer 20*b*, an organic photosensitive layer formed of an organic photoconductor or an inorganic photosensitive layer formed of an inorganic photoconductor, or the like can be used, and preferable is an amorphous silicon photosensitive layer formed by vapor deposition of silane gas or the like, for its high durability. The photosensitive drums 20, based on the light beams emitted from the exposure unit 25 to their surfaces, carry toner images of the different colors so as to transfer the toner images to the intermediate transfer belt 22, and are, as shown in FIG. 1, arranged together with the developing devices 21 under the intermediate transfer belt 22. The condition of the surfaces of the photosensitive drums 20 at an early stage of use will be described later.

As shown in FIGS. 1 and 2, there are arranged, around the photosensitive drum 20, a charging roller (charging member) 26, an exposure unit 25, a developing device 21, a cleaning device 28, and a destaticizer 29. Across the intermediate transfer belt 22, a primary transfer roller 27 is arranged opposite the photosensitive drum 20.

Toner images transferred to the intermediate transfer belt 22 in primary transfer portions which are constituted by cooperation between the photosensitive drums 20 and the fixed magnet bodies 27 are transferred in the secondary transfer portion 17 to the recording sheet transported through the recording sheet transport passage 16 from the sheet feed cassette 13 or from the manual feed tray.

Structure of Developing Device 21:

The developing devices 21 having basically the same structure are aligned under the intermediate transfer belt 22 along its rotation movement direction. The developing device 21 develops into a toner image the electrostatic latent image formed on the surface of the photosensitive drum 20 by attaching toner containing a toner external additive (abrasive particles) comprising metal particles such as titanium oxide. As the developing device 21, a conventionally well-known one can be used.

Structure of Intermediate Transfer Belt 22:

The intermediate transfer belt 22 is an endless belt wound, under tension, around a driving roller and a following roller in the horizontal direction in the printer body 12, and is driven to rotate as the driving roller is rotated by a belt driving motor (unillustrated) as image formation proceeds.

Structure of Toner Density Detecting Sensor 23:

A toner density detecting sensor 23 measures the reflection density of toner images on the intermediate transfer belt 22 and outputs the detection value to a control circuit 30 (see FIG. 2). Toner density detecting sensors 23 can be arranged one at each of a plurality of places along the intermediate transfer belt 22 in each of its rotation movement direction and its width direction orthogonal to the rotation movement direction. Here, if a toner density detecting sensor 23 detects toner density only at one side of the intermediate transfer belt 22 in its width direction, it cannot deal with, for example, a phenomenon (lopsided toner distribution) where density differs between opposite end parts of the intermediate transfer belt 22 in its width direction; it is thus preferable that a toner density detecting sensor 23 be arranged at each of the opposite ends in the width direction.

Structure of Charging Roller 26:

The charging roller 26 is formed of, for example, electrically conductive rubber, and is arranged in contact with the photosensitive drum 20. As shown in FIG. 2, as the photosensitive drum 20 rotates in the clockwise direction, the charging roller 26 in contact with the surface of the photosensitive drum 20 follows this by rotating in the counter-clockwise direction. Here, applying a predetermined voltage to the charging roller 26 allows the surface of the photosensitive drum 20 to be electrostatically charged uniformly. As the charging roller 26 rotates, a charged cleaning roller (unillustrated) in contact with the charging roller 26 is driven to rotate in the clockwise direction to remove foreign matter attached to the surface of the charging roller 26.

Structure of Cleaning Device 28:

The cleaning device 28 includes a cleaning housing 40 which has a depth in the recording sheet width direction (direction orthogonal to the recording sheet transport direction), a collection spiral 41 which is arranged inside the cleaning housing 40 in a lower part of it and which transports, while rotating in the clockwise direction in FIG. 2, collected toner to one side in the recording sheet width direction so as to feed the toner to a waste toner container (unillustrated), a cleaning blade 42 which is fitted outside the cleaning housing 40 in a lower part of it, a rubbing roller (cleaning roller) 43 which is arranged inside the cleaning housing 40 in an upper part of it so as to be in contact with the surface of the photosensitive drum 20, and a scraper 44 which is arranged over the rubbing roller 43 so as to be in contact with the surface of the rubbing roller 43.

The cleaning blade 42 is formed of urethane rubber or the like. The cleaning blade 42 is arranged so that its tip end makes contact with the surface of the photosensitive drum 20 from below the rotary axis of the photosensitive drum 20. Here, the tip end of the cleaning blade 42 makes contact with the photosensitive drum 20 from a direction counter to its rotation direction (see the arrow in FIG. 2).

The rubbing roller 43, while collecting waste toner from the surface of the photosensitive drum 20, polishes the surface of the photosensitive drum 20 by use of the waste toner attached to the surface of the rubbing roller 43. To that end, the rubbing roller 43 has to have a high waste toner holding ability, and to achieve that, it is formed of foam rubber (for example, carbon containing electrically conductive EPDM foam) in a cylindrical shape extending in the recording sheet width direction, and is arranged on the upstream side of the tip end of the cleaning blade 42 with respect to the rotation direction of the photosensitive drum 20. The rotation direction of the rubbing roller 43 is opposite to the rotation direction of the photosensitive drum 20. The scraper 44 is formed of a thin metal plate that has sufficient durability, and its tip end makes contact with the rubbing roller 43, on the downstream side thereof with respect to its rotation direction, from a direction counter to it so as to make uniform the amount of toner attached to the surface of the rubbing roller 43.

Structure of Destaticizer 29:

The destaticizer 29 is arranged along the rotation direction of the photosensitive drum 20, on the downstream side of the cleaning device 28. The destaticizer 29 comprises an LED (light-emitting diode) and is provided with a reflection plate as necessary. The destaticizer 29 removes, by irradiating the photosensitive drum 20 with destaticizing light (erase light), electrostatic charge from its surface in preparation for the electrostatic charging step in the subsequent image formation.

Structure of Control Circuit 30:

The control circuit 30 performs image formation (a print job) based on various control programs relating to image formation in general stored in a ROM 31, and, while performing it, controls a bias circuit 34 which applies a bias having an AC bias and a DC bias superimposed on each other as a charging bias to the charging roller 26.

The voltage applied by the bias circuit 34 is controlled by use of a multiplication value G set based on a count value N (the cumulative number of printed sheets, corresponding to a cumulative value in the present disclosure) of a counter 39 which counts the number of sheets subjected to image formation. The multiplication value G defines the voltage of the AC component of the bias voltage. The cumulative count number N of the counter 39 is reset every time the photosensitive drum 20 is replaced.

The control circuit 30 controls, via a motor driving driver 35, a driving motor (driving device) 36 which makes the photosensitive drum 20 rotate. The control circuit 30 is fed with the count value (the cumulative number of printed sheets) of the counter 39 which counts the number of sheets subjected to image formation.

In the ROM 31, a control program relating to image formation correction according to the present disclosure is also stored; the ROM 31 thus constitutes a microcomputer together with the control circuit 30 which executes the image formation control program. Image data and the like for image formation are temporarily stored in a RAM 32 or in an HDD 33. The control circuit 30 stores the result of detection by the toner density detecting sensor 23 in the RAM 32 or in the HDD 33.

The control circuit 30 executes, in addition to the above described control, calibration of developing conditions such as the amount of toner supplied to the developing devices 21 and a bias voltage applied to the developing devices 21, exposure conditions such as the laser power of the laser light P (see FIG. 1) emitted from the exposure unit 25, the amount of destaticizing light from the destaticizer 29, etc.

2. Procedure for Image Formation

Now, a procedure for image formation in the image forming apparatus 11 will be described. When image data is fed in from an externally connected device such as a personal computer, the surfaces of the photosensitive drums 20 are first electrostatically charged uniformly by the charging rollers 26 and are then irradiated with the laser light P by the exposure unit 25, and thereby electrostatic latent images based on the image data are formed on the photosensitive drums 20. The developing devices 21 are filled with a predetermined amount of two-component developer (hereinafter also referred to simply as developer) containing toner of different colors, namely yellow, magenta, cyan, and black. When the proportion of toner contained in the two-component developer stored in the developing devices 21 falls below a predetermined value through formation of toner images, which will be described later, toner is supplied from the toner containers 19 to the developing devices 21. The toner contained in the developer is fed to the photosensitive drums 20 by the developing devices 21, so that the developer attaches to it electrostatically, and thereby toner images are formed based on the electrostatic latent images formed by exposure to light from the exposure unit 25.

On the other hand, in coordination with toner image formation in the image formation processing section 15, a recording sheet is fed from the sheet feed cassette 13 (or the manual feed tray) and is transported through the recording sheet transport passage 16 to a registration roller pair 30*a*.

Then, by the primary transfer rollers 27, an electric field is applied between the primary transfer rollers 27 and the photosensitive drums 20 with a predetermined transfer voltage, and the toner images of the different colors, namely yellow, magenta, cyan, and black, on the photosensitive drums 20 are primarily transferred to the intermediate transfer belt 22. These four-color images are formed in a predetermined positional relationship so as to form a predetermined full-color image. Thereafter, in preparation for subsequent formation of new electrostatic latent images, toner and the like left unused on the surfaces of the photosensitive drums 20 after the primary transfer are removed by the cleaning devices 28. The residual electric charge on the surfaces of the photosensitive drums 20 is also removed by the destaticizers 29.

As the intermediate transfer belt 22 starts to rotate in the counter-clockwise direction in FIG. 1, the recording sheet is transported with predetermined timing from the registration roller pair 30*a* to the secondary transfer portion 17 arranged next to the intermediate transfer belt 22, and the full-color image on the intermediate transfer belt 22 is secondarily transferred to the recording sheet. The recording sheet to which the toner image has been secondarily transferred is transported to the fixing portion 18. Unused toner and the like attached on the surface of the intermediate transfer belt 22 are removed by the belt cleaning device 24.

The recording sheet transported to the fixing portion 18 is then heated and pressed there, so that the toner image is fixed to the surface of the recording sheet to form the predetermined full-color image. The recording sheet on which the full-color image has been formed is guided to an end part of the recording sheet transport passage 16 and is discharged by a discharge roller pair 30*b* onto a discharge tray 12*a* which doubles as a top surface of the printer body 12.

3. Condition of Surface of Photosensitive Drum 20 at Early Stage of Use

In this embodiment, the photosensitive drum 20 used in the image forming apparatus 11 preferably has a surface roughness configured such that, at an early stage of use, the surface of the photosensitive layer 20*b* has, in terms of surface roughness, an arithmetic average roughness Ra of 20 nm to 100 nm, a ten-spot average roughness Rz of 0.2 μm to 1.0 μm, an average concave-to-convex distance Sm of 20 μm or less, the ratio (Ra nm/Sm μm) of the arithmetic average roughness Ra nm to the average concave-to-convex distance Sm μm being three or more, and a skewness of 0.3 or more. In the present specification, an early stage of use of the photosensitive drum 20 means when the photosensitive drum 20 is brand-new, before being subject to durability printing. The photosensitive drum 20 is required to have the above described surface condition at least at an early stage of use (the condition is thus a condition before the start of use, in other words, immediately after factory shipment). The arithmetic average roughness Ra, the ten-spot average roughness Rz, and the average distance Sm are measured by use of a touch needle type two-dimensional roughness tester by a surface roughness measuring method prescribed in JIS B0601, 1994.

(1) Arithmetic Average Roughness Ra:

When the arithmetic average roughness Ra is less than 20 nm, the cleaning blade 42 is worn by use for a long period of time; this increases the slipping amount of an external additive which leads to image defects. When the arithmetic average roughness Ra is more than 100 nm, the charging roller 26 starts to be contaminated from a relatively early stage of durability printing; this makes it difficult to use it for a long period of time. That is, when the surface irregularities on the surface of the photosensitive drum 20 are large, a toner external additive is prone to slip through at an early stage of use. Thus, at an early stage of use, the surface of the photosensitive layer 20*b* preferably has an arithmetic average roughness Ra in a range of 20 nm to 100 nm.

(2) Ten-Spot Average Roughness Rz:

When the surface of the photosensitive layer 20*b* of the photosensitive drum 20 at an early stage of use has an arithmetic average roughness Ra in a range of 20 nm to 100 nm, the ten-spot average roughness Rz is preferably in a range of 0.2 μm to 1.0 μm.

The basis for the above definition is as follows: Even with an arithmetic average roughness Ra within the above described range, when there are large surface irregularities, the cleaning blade 42, despite deforming to some degree, has difficulty following the surface of the photosensitive drum 20, with the result that a large gap tends to be formed between the photosensitive drum 20 and the cleaning blade 42. With a large gap between the photosensitive drum 20 and the cleaning blade 42, the external additive and the like are likely to slip through.

In other words, when the photosensitive drum 20 has large convexities on its surface, and the cleaning blade 42 makes contact only with the tip ends of the convexities, concavities located between the large convexities do not make contact with the cleaning blade 42; it then makes no sense to define the range of the arithmetic average roughness Ra. That is, the photosensitive drum 20 preferably has fine surface irregularities on its surface but not outstanding ones, and this requirement is defined in terms of the ten-spot average roughness Rz and the arithmetic average roughness Ra. Here, defining the ten-spot average roughness Rz ensures that there are no outstanding surface irregularities.

(3) Average Concave-To-Convex Distance Sm:

Even with an arithmetic average roughness Ra and a ten-spot average roughness Rz both within the above described ranges, when large convexities are located apart from each other, the cleaning blade 42 makes contact with (is supported on) the large convexities. Here, whether or not large convexities are located apart from each other is checked based on the average concave-to-convex interval Sm of surface irregularities.

The cleaning blade 42 is elastically deformable and is deformed between large convexities so as to make contact with the photosensitive drum 20. In particular, with wide intervals between convexities, the cleaning blade 42 and the photosensitive drum 20 have an increased contact area between them. The increased contact area results in an increased driving torque of the photosensitive drum 20 due to friction with the cleaning blade 42, leading to greater wear on the cleaning blade 42; eventually, stick-slip occurs on the cleaning blade 42, letting the external additive slip through, or causing a broken edge in the cleaning blade 42. Needless to say, with a broken edge in the cleaning blade 42, a satisfactory image cannot be obtained.

With a large average concave-to-convex distance Sm, the convexities are large (elevations have wide bases), and when the peaks of convexities are worn after use for a long period of time, wide flat parts are formed at the peaks, resulting in an increased contact area with the cleaning blade 42. Thus, when the surface of the photosensitive layer 20*b* of the photosensitive drum 20 at an early stage of use has an arithmetic average roughness Ra in a range of 20 nm to 100 nm and a ten-spot average roughness Rz in a range of 0.2 μm to 1.0 μm, the average concave-to-convex distance Sm preferably is 20 μm or less.

Forming surface irregularities that fulfill the above noted ranges of roughness irregularly on the surface of the photosensitive layer 20*b* in the axial and circumferential directions of the photosensitive drum 20 helps reduce the friction between the photosensitive drum 20 and the cleaning blade 42, and helps reduce the driving torque of the photosensitive drum 20 and the wear on the edge of the cleaning blade 42. In particular, when Ra nm/Sm μm≥3 holds, surface irregularities have a height (depth) which is three times or more larger than the average concave-to-convex distance Sm; this helps reduce the contact area, and hence helps effectively reduce the friction, between the photosensitive drum 20 and the cleaning blade 42.

Surface irregularities on the surface of the photosensitive layer 20*b* can be adjusted to fulfill the above noted ranges, for example, by subjecting the circumferential surface of a metal tube (the tube 20*a*) as a support formed of aluminum or the like to surface roughening by blasting or the like, and then forming an amorphous silicon layer (the photosensitive layer 20*b*) on its surface.

(4) Skewness Rsk:

Fulfilling skewness Rsk≥0.3 helps reduce the contact area, and hence helps effectively reduce the friction, between the photosensitive drum 20 and the cleaning blade 42. The surface roughness is thus such that the skewness Rsk is 0.3 or more. The methods of measuring the arithmetic average roughness Ra, the ten-spot average roughness Rz, and the average concave-to-convex distance Sm are the same as in first and second embodiments.

Here, the skewness Rsk is one of parameters that express different degrees of surface roughness, and expresses the symmetry between convexities and concavities (the skewness of surface irregularities) with respect to the average line at the center. As given by Formula (1) below, it is expressed in terms of the cubic mean of Z(x) for a sampling length rendered dimensionless through the cubing of the root mean squared height Rq.

$$Rsk = \frac{1}{Rq^3}\left[\frac{1}{l}\int_0^l Z^3(x)\,dx\right] \quad \text{[Formula 1]}$$

Figure 3:
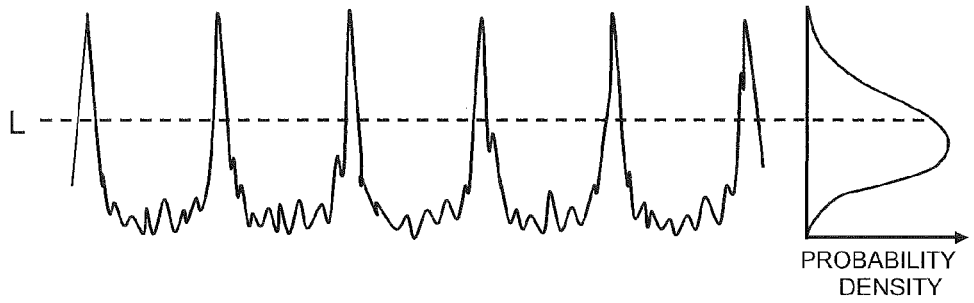
FIG. 3 is a diagram showing surface irregularities with a skewness Rsk greater than zero.
Figure 4:
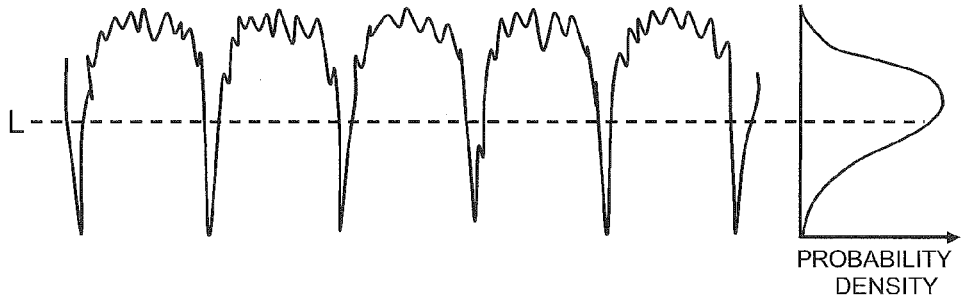
FIG. 4 is a diagram showing surface irregularities with a skewness Rsk less than zero.

When Rsk is greater than zero, as shown in FIG. 3, surface irregularities are lopsided downward relative to the average line L. On the other hand, when Rsk is less than zero, as shown in FIG. 4, surface irregularities are lopsided upward relative to the average line L. That is, it is considered that, with a skewness Rsk greater than zero, the photosensitive layer 20*b* is to a greater degree in point contact with the cleaning blade 42, leading to a reduced contact area between them.

(5) DUH Hardness:

The DUH hardness of the photosensitive layer 20*b* of the photosensitive drum 20 at an early stage of use is preferably in a range of 500 kgf/mm$^2$ to 1200 kgf/mm$^2$. With a DUH hardness of 500 kgf/mm$^2$ or less, the cleaning blade 42 and the rubbing roller 43 make contact with each other; the photosensitive layer 20*b* of the photosensitive drum 20 is then worn more easily and cannot be used for a long period of time. From this perspective, a high DUH hardness is preferable. Accordingly, the upper limit of the DUH hardness is defined by the hardness of the photosensitive layer 20*b* with the highest hardness that is currently available. The DUH hardness refers to indentation hardness (Martens hardness) measured by a dynamic ultra micro hardness tester (DUH series, manufactured by Shimadzu Corporation).

(6) Configuration of Surface Irregularities:

Surface irregularities on the surface of the drum are preferably distributed irregularly in the axial and circumferential directions of the photosensitive drum 20. Here, irregularly means that no particular regularity is observable in the distribution of surface irregularities when these are seen from one arbitrary direction within a plane.

(7) Area:

The arithmetic average roughness Ra, the ten-spot average roughness Rz, and the average concave-to-convex distance Sm are preferably within the previously described ranges over the entire image formation area on the surface of the photosensitive drum 20.

(8) Toner External Additive:

To toner, as an external additive, electrically conductive abrasive particles comprising titanium oxide, silica, or the like are externally added. With a large arithmetic average roughness Ra on the surface of the photosensitive layer 20*b*, the external additive slips through gaps between surface irregularities which the cleaning blade 42 cannot follow. Thus, in this embodiment, the toner external additive used in the photosensitive drum 20 preferably has an average primary particle diameter of 10 nm or more.

4. Setting of AC Bias Applied to Charging Roller 26

Now, the distinctive features of the image forming apparatus 11 according to the present disclosure will be described. In the image forming apparatus 11 according to the present disclosure, an AC bias applied to the charging roller 26 is set based on the cumulative number of printed sheets counted from an early stage of use of the photosensitive drum 20. To the charging roller 26, a bias having an AC bias and a DC bias superimposed on each other is applied, and the DC bias is set at a proper value.

Figure 5:
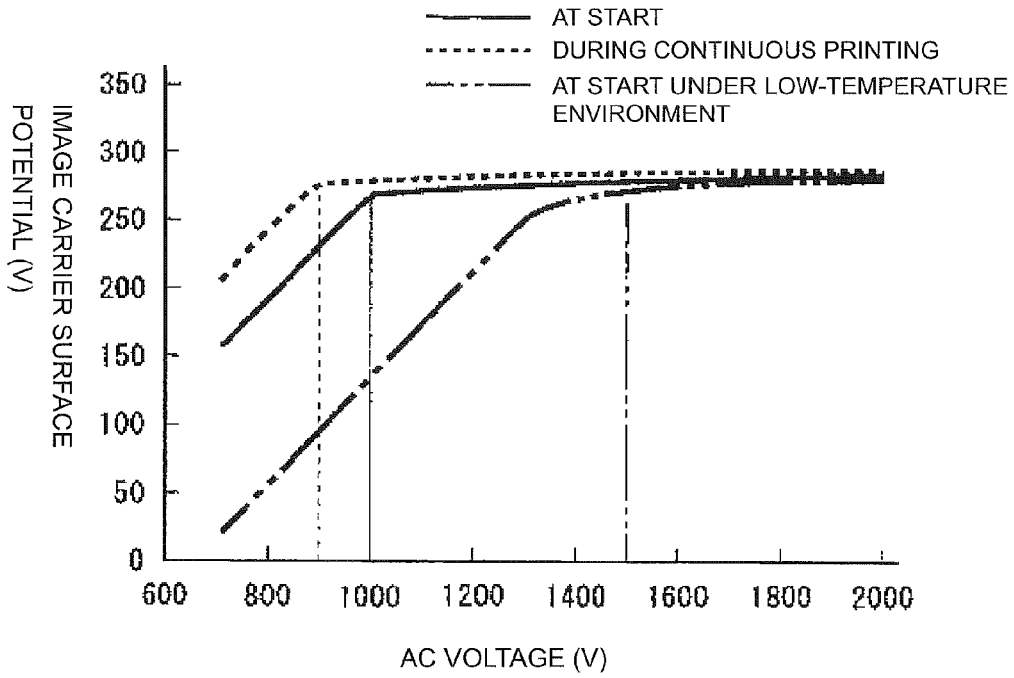
FIG. 5 is a chart showing the relationship between the surface potential on a photosensitive drum 20 and an AC bias applied to a charging roller 26.

FIG. 5 is a chart showing the relationship between the surface potential on the photosensitive drum 20 and the peak-to-peak value of the AC bias applied to the charging roller 26 by the bias circuit 34. As shown in FIG. 5, as the peak-to-peak value of the AC bias increases, the surface potential of the photosensitive drum 20 rises linearly until the AC bias value reaches a certain value, and thereafter the surface potential of the photosensitive drum 20 remains substantially constant. The ratio of the AC bias to the AC bias value (reference AC bias) at this border is the multiplication value G.

The AC bias required to electrostatically charge the photosensitive drum 20 varies with design conditions or environmental conditions, and although every situation has a proper value, generally, with a multiplication value G of one or more, the surface potential of the photosensitive drum 20 is stable. The AC bias value at the border where G=1 is generally twice the discharge start voltage of the DC bias. Although electric discharge occurs with the DC bias alone, superimposing the AC bias on it helps obtain a stable surface potential.

In FIG. 5, the relationship between the surface potential of the photosensitive drum 20 and the AC bias applied by the bias circuit 34 is shown for the following three cases: at the start of printing under a normal-temperature environment; during continuous printing under a normal-temperature environment; and at the start of printing under a low-temperature environment. As image formation continues, the photosensitive drum 20 and the charging roller 26 warm up, and thus, when the charging roller 26 is nearly brand-new with hardly any deterioration, a lower AC bias will do to electrostatically charge the photosensitive drum 20. As a result, an AC bias higher than necessary is applied, and discharge products are more likely to be produced on the surface of the photosensitive drum 20. For example, in a case where the interior temperature of the body of the image forming apparatus 11 is equal to that under a normal-temperature environment (for example, an interior temperature of 23° C.), when image formation is started, a proper value of the AC bias is around 1000 (V), and during continuous image formation, a proper value of the AC bias may be around 900 (V). In a case where the interior temperature at the start of image formation is equal to that under a low-temperature environment (for example, an interior temperature of 10° C.), a proper value of the AC bias is around 1500 (V).

Table 1 shows one example of the relationship between the period of time T after the start of use of the photosensitive drum 20 in the image forming apparatus 11 according to the present embodiment and the AC bias V applied to the charging roller 26 by the bias circuit 34. The period of time T after the start of use is represented by the cumulative count number N of the counter 39 that indicates the cumulative value of the number of printed sheets (the cumulative number of printed sheets) counted from the start of use of the photosensitive drum 20. The AC bias V is represented by the multiplication value G.

TABLE 1

| Period of Time T After Start of Use | First Period of Time T1 | Second Period of Time T2 | Third Period of Time T3 |
|---|---|---|---|
| Cumulative Count Number N | N < 10,000 | 10,000 ≤ N ≤ 300,000 | 300,000 < N |
| Multiplication Value G | 0.97 ≤ G < 1.00 | 1.00 ≤ G < 1.20 | 0.97 ≤ G < 1.10 |
| AC Bias V | V1 | V2 | V3 |

Figure 6:
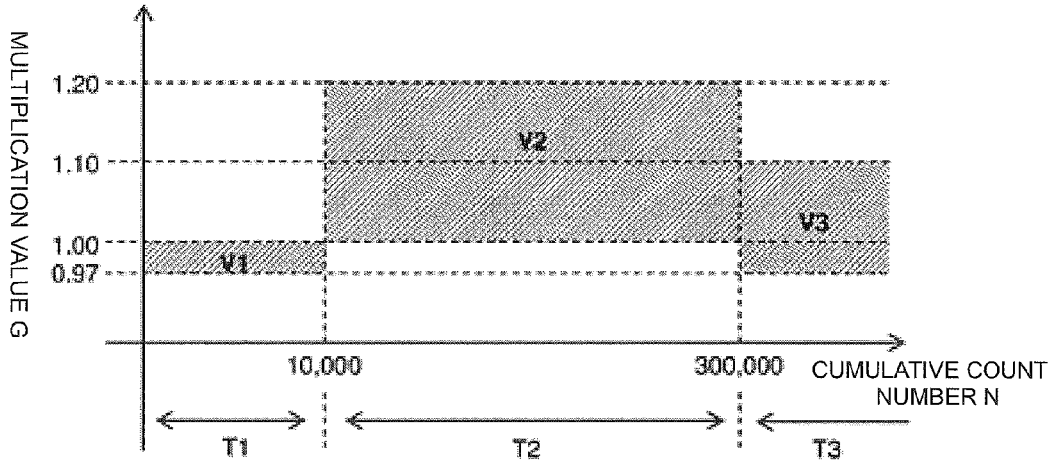
FIG. 6 is a chart showing the relationship between an AC bias applied to a charging roller 26 and the period of time after the start of use of a photosensitive drum 20 in an image forming apparatus 11 according to the present embodiment.

FIG. 6 is a chart showing one example of the relationship between the cumulative count number N and the multiplication value G shown in Table 1. As shown in Table 1 and in FIG. 6, in the first period of time T1 when the cumulative count number of sheets N is less than 10,000, the first AC bias V1 is applied such that the multiplication value G satisfies 0.97≤G<1.00. In the second period of time T2 when the cumulative count number of sheets N is 10,000 or more but 300,000 or less, the second AC bias V2 is applied such that the multiplication value G satisfies 1.00≤G<1.20. In the third period of time T3 when the cumulative count number of sheets N is more than 300,000, the third AC bias V 3 is applied such that the multiplication value G satisfies 0.97≤G<1.10.

5. Setting Control of AC Bias Applied to Charging Roller 26

Figure 7:
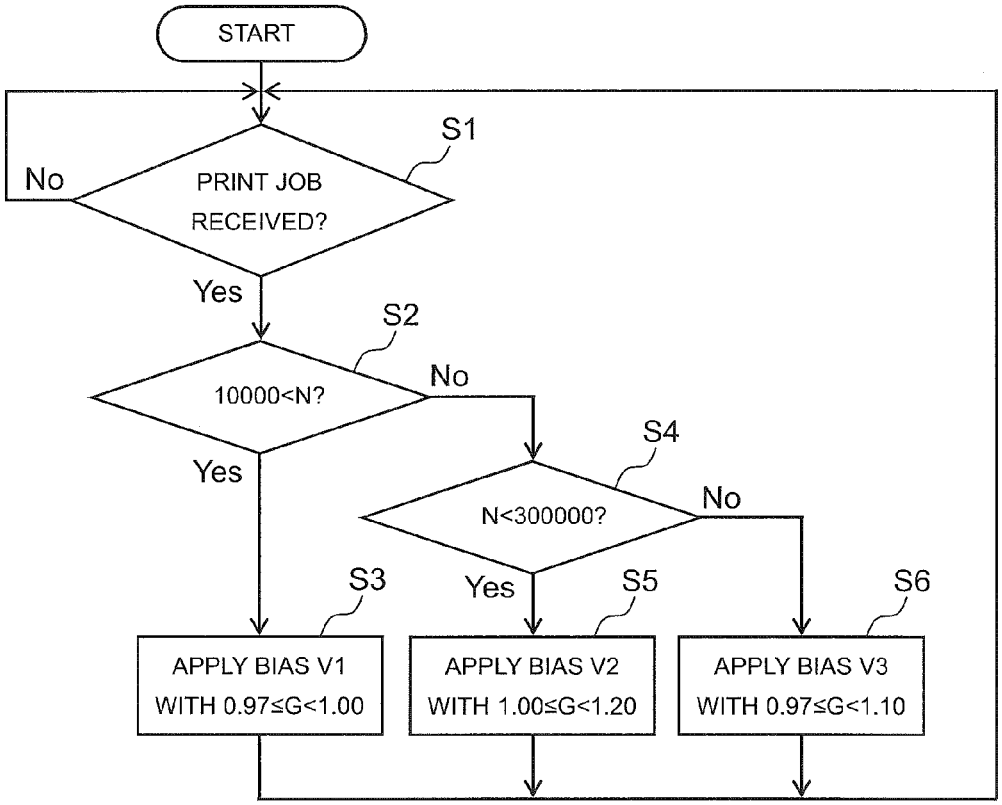
FIG. 7 is a flow chart showing the content of an AC bias setting control process performed in an image forming apparatus 11 according to the present embodiment.

FIG. 7 is a flow chart showing the content of the bias setting control process whereby the control circuit 30 in the image forming apparatus 11 according to the present embodiment sets the AC bias applied to the charging roller 26 via the bias circuit 34. There is an unillustrated main routine that controls the entire image forming apparatus 11, and the flow shown in FIG. 7 is a subroutine of the main routine. The subroutine shown in FIG. 7 for image quality degradation suppression control starts when the power to the image forming apparatus 11 is turned on.

The control circuit 30 first monitors whether or not a print job is received (step S1). A print job is received through input by a user via a control panel of the image forming apparatus 11 or through input from a PC or the like connected via a communication network such as a LAN or the Internet. When no print job is received (No in step S1), the control circuit 30 continues with monitoring.

When a print job is received (Yes in step S1), the control circuit 30 checks whether or not the cumulative count number of sheets N (the cumulative number of printed sheets counted from an early stage of use of the photosensitive drum 20) counted by the counter 39 is less than 10,000 (step S2). When the cumulative count number of sheets N is less than 10,000 (during the first period of time T1) (Yes in step S2), the control circuit 30 makes the bias circuit 34 apply the first AC bias V1 to the charging roller 26 with the multiplication value G in a range of 0.97≤G<1.00 (step S3).

When the cumulative count number N is not less than 10,000, that is, when the cumulative count number N is 10,000 or more (during the second period of time T2 or during the third period of time T3) (No in step S2), it is then checked whether or not the cumulative count number of sheets N is less than 300,000 (step S4).

When the cumulative count number of sheets N is less than 300,000 (during the second period of time T2) (Yes in step S4), the control circuit 30 makes the bias circuit 34 apply the second AC bias V2 to the charging roller 26 with the multiplication value G in a range of 1.00≤G≤1.20 (step S5).

When the cumulative count number of sheets N is not less than 300,000, that is, when the cumulative count number of sheets N is 300,000 or more (during the third period of time T3) (No in step S4), the control circuit 30 makes the bias circuit 34 apply the third AC bias V3 to the charging roller 26 with the multiplication value G in a range of 0.97≤G≤1.10 (step S6). Thereafter, a return is made to step S1, where the control circuit 30 monitors whether or not a print job is received, and thereafter the same procedure (steps S1 to S6) is repeated.

In the image forming apparatus 11 according to this embodiment, in the first period of time T1 (N<10,000), that is, at an early stage of use of the photosensitive drum 20, the multiplication value G is set lower than during the second period of time T2 (10,000≤N≤300,000) such that V1<V2. This helps suppress, in the first period of time T1, production of discharge products and slipping-through of the external additive due to stick-slip. In the first period of time T1, that is, at an early stage of use of the photosensitive drum 20, the photosensitive drum 20 and the charging roller 26 are relatively clean, and thus, even when the multiplication value G is set lower so as to apply a lower AC bias V, degradation in image quality degradation is considered to be ignorable.

Moreover, when the AC bias V is set relatively low, the surface potential of the electrostatically charged photosensitive drum 20 is relatively low; this reduces the attaching force of toner and external additive with respect to the surface of the photosensitive drum 20. As a result, toner and external additive are easily removed by destabilization by the destaticizer 29, and by cleaning by the cleaning blade 42 and the rubbing roller 43, and also less external additive slips through a gap between the surface of the photosensitive drum 20 and the cleaning blade 42.

Thus, setting the first AC bias V1 in the first period of time T1, that is, at an early stage of use of the photosensitive drum 20, lower than the second AC bias V2 in the second period of time T2 helps suppress slipping-through of the external additive without sacrificing image quality.

On the other hand, in the third period of time T3, in which the cumulative count number N is 300,000<N, through previous use, discharge products have already attached to the surface of the photosensitive drum 20 and surface irregularities on the surface of the photosensitive drum 20 have worn to have a small surface roughness; thus, stick-slip is more likely to occur. Accordingly, the multiplication value G is set lower than in the second period of time T2 to suppress production of discharge products. Here, unlike at an early stage of use, the charging roller 26 is already contaminated to some degree; thus, if the AC bias V is set too low, notable degradation in image quality may result. To prevent that, for the third AC bias V3 applied in the third period of time T3, the upper limit of the multiplication value G is set higher than in the first period of time T1.

As described above, in the image forming apparatus 11 according to the present embodiment, at an early stage of use of the photosensitive drum 20, when its surface has a large roughness, slipping-through of an external additive can be suppressed.

MODIFIED EXAMPLES

While a specific example of an image forming apparatus 11 embodying the present disclosure has been described above, this is in no way meant to limit the present disclosure, which thus allows for, for example, modifications as noted below. The embodiment can be combined with a modified example, and a modified example can be combined with another. The present disclosure encompasses any example not described as an embodiment and any design change within the spirit of the present disclosure.

Modified Example 1

The multiplication value G can be previously set at a predetermined value within each range.

Modified Example 2

The voltage when G=1 as a reference value of the multiplication value varies with the environment (temperature, humidity, and the like) in which the image forming apparatus 11 is arranged and with the resistance of the rubber base material of the charging roller 26. Thus, the multiplication value G can be set at an optimum value determined based on the environment at the moment within each range.

Modified Example 3

The method for counting the cumulative number of printed sheets is not limited to counting by the counter 39; instead, for example, the count can be stored in a RAM 53 or the like.

Modified Example 4

In the above-described embodiments, the first to third periods of time T1 to T3 are expressed by the cumulative count number N of the counter 39. This, however, is not meant as any limitation; they can be expressed by the cumulative driving time of the photosensitive drum 20.

Modified Example 5

In the third period of time T3, the range of the multiplication G can be the same as in the second period of time T2; that is, V2 and V3 can be equal.

INDUSTRIAL APPLICABILITY

The present disclosure is applicable to image forming apparatuses provided with an image carrier that has a toner image formed on its surface. Based on the present disclosure, it is possible to provide an image forming apparatus that can suppress slipping-through of an external additive at an early stage of use, when the surface of the image carrier has a large surface roughness.

What is claimed is:

1. An image forming apparatus comprising:

an image carrier on a surface of which a toner image is formed;

a cleaning member arranged in contact with the surface of the image carrier, the cleaning member cleaning the surface of the image carrier;

a charging member for electrostatically charging the image carrier;

a bias applying device for applying a charging bias having a DC bias and an AC bias superimposed on each other to the charging member; and a control portion for controlling the charging bias applied to the charging member by the bias applying device, wherein in a first period of time from a start of use of the image carrier to a predetermined time thereafter, the control portion uses as the AC bias applied to the charging member a first AC bias, and in a second period of time subsequent to the first period of time, the control portion uses as the AC bias a second AC bias higher than the first AC bias, the control portion uses as a reference AC bias an AC bias having a voltage level over which a surface potential of the image carrier remains substantially constant against increase of the AC bias applied to the charging member by the bias applying device, the control portion takes as multiplication values for the first and second AC biases respectively a ratio of the first AC bias to the reference AC bias and a ratio of the second AC bias to the reference AC bias so as to set the first and second AC biases such that the multiplication values therefor are in predetermined ranges respectively, the control portion sets the multiplication value for the second AC bias higher than the multiplication value for the first AC bias, in a third period of time subsequent to the second period of time, the control portion sets a maximum value of the multiplication value for a third AC bias applied to the charging member higher than a maximum value of the multiplication value for the first AC bias but lower than a maximum value of the multiplication value for the second AC bias, and the control portion sets a minimum value of the multiplication value for the third AC bias equal to a minimum value of the multiplication value for the first AC bias and lower than a minimum value of the multiplication value for the second AC bias.

2. The image forming apparatus of claim 1, further comprising:

a printed sheets number count portion which counts a cumulative number of printed sheets starting with the start of use of the image carrier, wherein the control portion determines the first and second periods of time based on the cumulative number of printed sheets counted by the printed sheets number count portion.

3. The image forming apparatus of claim 1, wherein at an early stage of use of the image carrier, the surface of the image carrier has an arithmetic average roughness Ra in a range of 20 nm or more but 100 nm or less, a ten-spot average roughness Rz in a range of 0.2 μm or more but 1.0 μm or less, and a DUH hardness in a range of 500 kgf/mm$^2$ or more but 1200 kgf/mm$^2$ or less.

4. The image forming apparatus of claim 1, wherein on the surface of the image carrier, an amorphous silicon photosensitive layer is formed.

* * * * *